US005996452A

United States Patent [19]

Chiang

[11] Patent Number: 5,996,452

[45] Date of Patent: Dec. 7, 1999

[54] CHUCK DEVICE FOR POWER TOOL

[76] Inventor: Shu Chi Chiang, No. 33-12, Lane 320, Sec. 1, Sa Tien Road, Da Du Hsiang, Taichung Hsien, Taiwan

[21] Appl. No.: 09/170,404

[22] Filed: Oct. 13, 1998

[51] Int. Cl.[6] ..... B25B 23/00; B25B 23/10; B25B 31/22

[52] U.S. Cl. ..... 81/429; 81/451; 81/456; 279/75; 279/905; 279/157

[58] Field of Search ..... 279/75, 905, 157; 81/429, 451–453, 455, 456, 474, 473

[56] References Cited

U.S. PATENT DOCUMENTS

| | | | |
|---|---|---|---|
| 3,583,715 | 6/1971 | Jahrl | 279/75 |
| 4,197,886 | 4/1980 | MacDonald | 408/56 |
| 4,753,142 | 6/1988 | Hornung | 81/429 |
| 5,682,800 | 11/1997 | Jore | 81/429 |
| 5,775,186 | 7/1998 | Rahm | 81/474 |

*Primary Examiner*—Steven C. Bishop

[57] ABSTRACT

A chuck device for a power tool includes a follower rotatably and slidably received in a tube and coupled to and driven by a power tool and having a hole for receiving a driving stem. One or more balls are slidably received in the follower and may be forced inward of the follower to engage with the driving stem for allowing the driving stem to be driven by the follower. The balls may be disengaged from the driving stem when the ball is received in the annular recess of the tube for preventing the driving stem from being over-driven by the power tool.

3 Claims, 5 Drawing Sheets

CHUCK DEVICE FOR POWER TOOL

BACKGROUND OF THE INVENTION

1. Field of the Invention

The present invention relates to a chuck device, and more particularly to a chuck device for a power tool.

2. Description of the Prior Art

Typical power tools comprise a chuck device for rotatably holding a driving member or for directly receiving a fastener in order to drive the fasteners. However, the chuck device have no safety device for preventing the driving member or the fastener from being over driven.

The present invention has arisen to mitigate and/or obviate the afore-described disadvantages of the conventional power tools.

SUMMARY OF THE INVENTION

The primary objective of the present invention is to provide a chuck device for a power tool having a safety device for preventing the driving member or the fastener from being over driven.

In accordance with one aspect of the invention, there is provided a chuck device for a power tool comprising a tube including an annular recess formed therein, a follower rotatably and slidably received in the tube, the follower including a first end having a hole formed therein and including a second end for coupling to and for being driven by the power tool, the follower including a middle portion having at least one orifice formed therein and including at least one first ball slidably received in the orifice and movable inward of the follower, a driving stem rotatably received in the follower and including a first end for engaging with and for driving a fastener. The first ball is forced inward of the hole of the follower to engage with the driving stem for allowing the driving stem to be driven by the follower, and the first ball is disengaged from the driving stem when the follower is moved relative to the tube until the first ball is received in the annular recess of the tube for preventing the driving stem from being over-driven by the power tool.

A disengaging means is further provided for disengaging the first ball from the annular recess of the tube and includes a cap secured to the second end of the follower and means for biasing the cap away from the tube.

The tube includes an annular groove formed therein, the driving stem includes an annular groove formed therein, the follower includes an aperture formed therein and includes a second ball slidably received in the aperture and engaged in the hole of the follower for engaging with the annular groove of the driving stem and for rotatably securing the driving stem in the hole of the follower, the second ball is allowed to be disengaged from the annular groove of the driving stem when the second ball is received in the annular groove of the tube.

A barrel is further secured to the tube and close to the first end of the follower, a chuck is slidably received in the barrel for retaining the fastener, and a spring means is further provided for biasing the chuck away from the first end of the follower.

Further objectives and advantages of the present invention will be come apparent from a careful reading of a detailed description provided hereinbelow, with appropriate reference to accompanying drawings.

DETAILED DESCRIPTION OF THE PREFERRED EMBODIMENT

Figure 1:
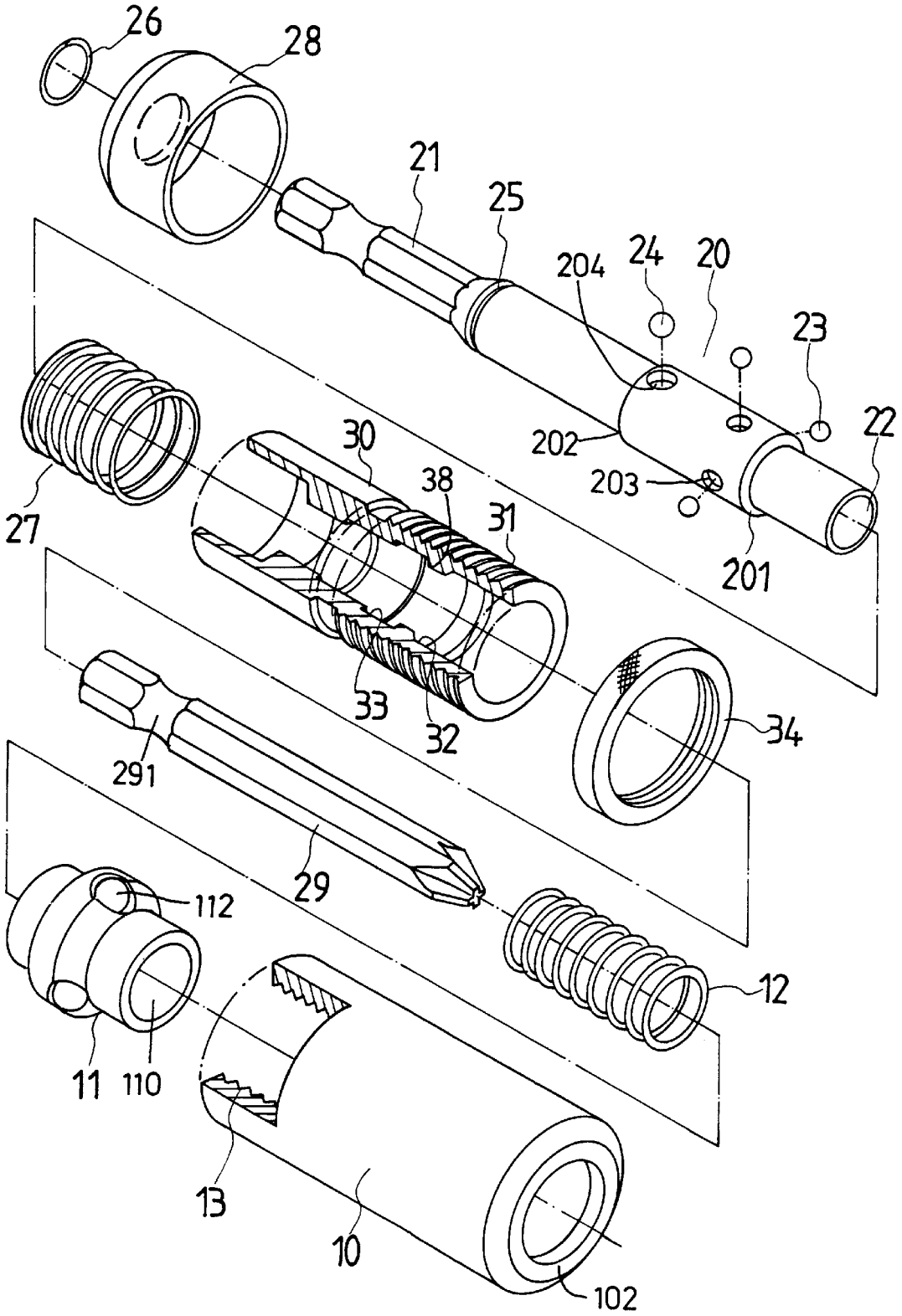
FIG. 1 is an exploded view of a chuck device in accordance with the present invention.
Figure 2:
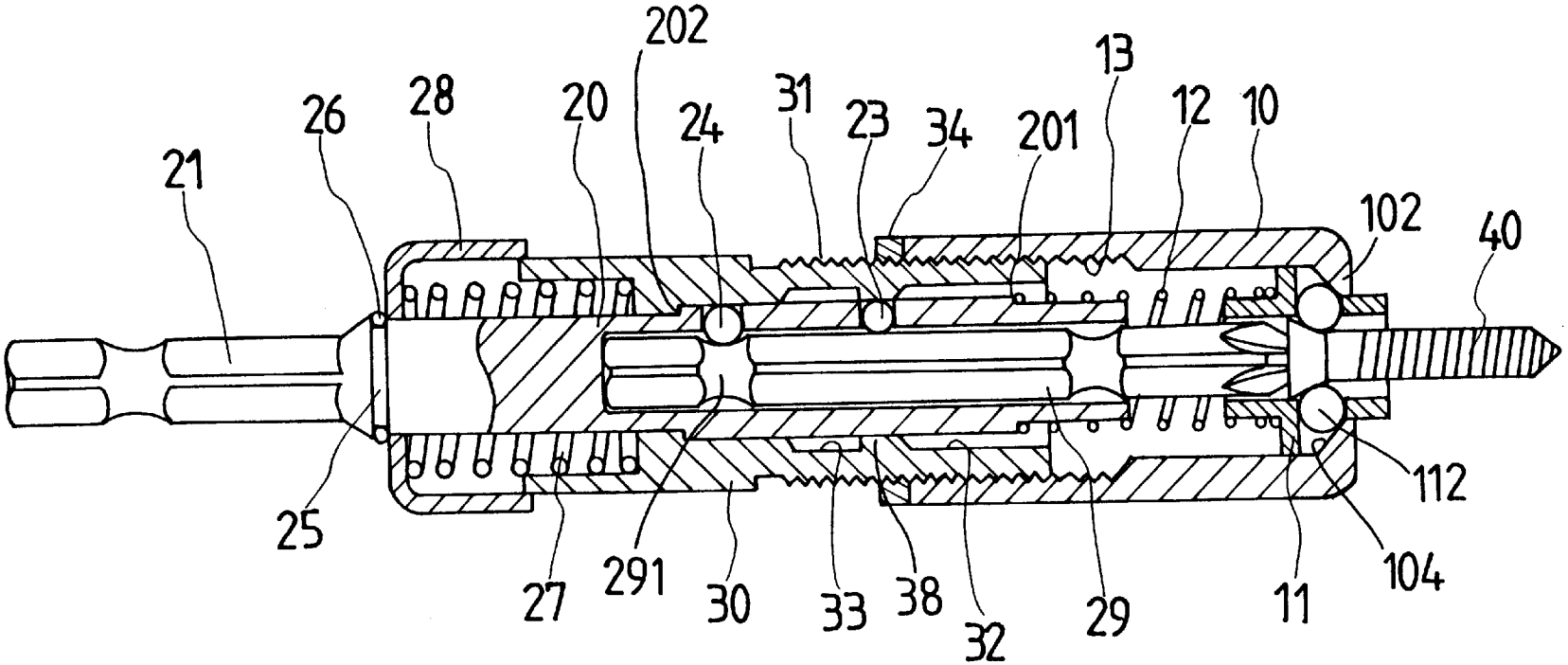
FIGS. 2 and 3 are cross sectional views illustrating the operation of the chuck device.

Referring to the drawings, and initially to FIGS. 1 and 2, a chuck device in accordance with the present invention is provided for use with a power tool, such as a hydraulic or pneumatic driving power tool or an electric power tool and comprises a barrel 10 including an inner thread 13 formed in the rear portion and including an annular flange 102 extended radially inward from the front end thereof and an inclined annular surface 104 formed in the annular flange 102. A chuck 11 is slidably received in the front portion of the barrel 10 and includes a bore 110 for slidably receiving a driving stem 29 and includes two or more balls 112 received in the middle portion for engaging with the inclined annular surface 104 of the barrel 10 and for retaining the head of the fastener 40 in place (FIG. 2). A tube 30 includes an outer thread 31 formed in the front end for engaging with the inner thread 13 of the barrel 10 and for securing to the barrel 10. A locking nut 34 may further be threaded with the outer thread 31 and engaged with the barrel 10 for solidly securing the tube 30 to the barrel 10. The tube 30 includes an annular recess 32 and an annular groove 33 formed therein and an annular bulge 38 formed between the annular recess 32 and the annular groove 33.

Figure 3:
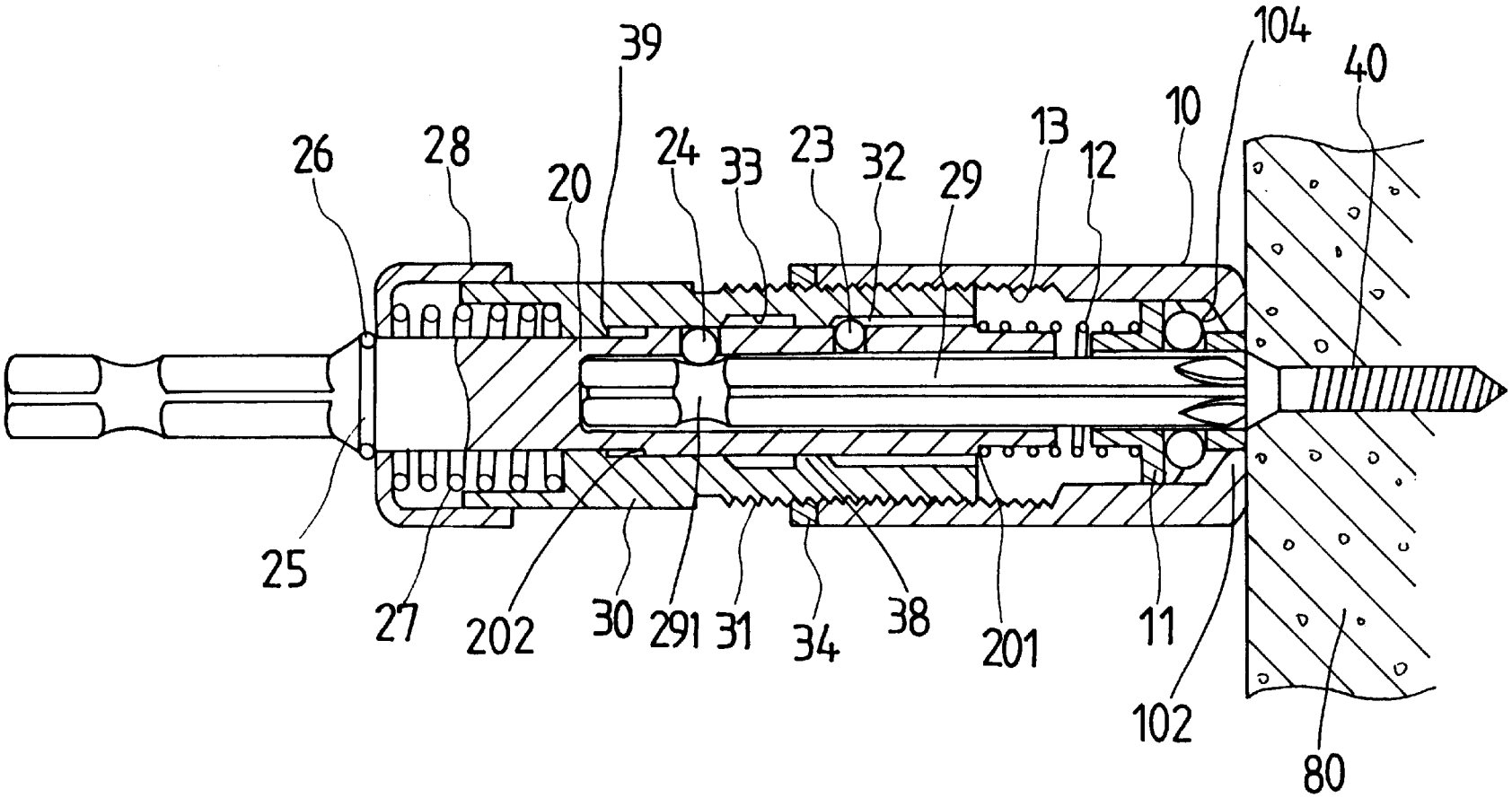

A follower 20 is rotatably and slidably received in the tube 30 and includes a hole 22 formed in the front portion for rotatably receiving the rear portion of the driving stem 29 and includes two annular shoulders 201, 202 formed in the front and the middle portions thereof respectively. A spring 12 is engaged between the annular shoulder 201 of the follower 20 and the check 11 for biasing the follower 20 away from the chuck 11. The follower 20 includes one or more orifices 203 and an aperture 204 formed in the middle portion and located between the annular shoulders 201, 202 for receiving balls 23, 24 respectively. The ball 24 may be forced to engage with the annular groove 291 of the driving stem 29 for rotatably securing the driving stem 29 in the follower 20 (FIGS. 2, 3). The balls 23 may be forced inward of the follower 20, by the annular bulge 38 (FIG. 2), to engage with the driving stem 29 for allowing the driving stem 29 to be driven by the follower 20. The follower 20 includes a stud 21 extended from the rear end and extended outward of the tube 20 for coupling to and for being driven by the power tool. A cap 28 is engaged with the follower 20. The follower 20 includes an annular slot 25 formed in the rear end for receiving a retaining ring 26 which is engaged with the cap 28 for preventing the cap 28 from being disengaged from the follower 20. A spring 27 is engaged between the tube 30 and the cap 28 for biasing the stud 21 of the follower 20 away from the tube 30. The annular shoulder 202 of the follower 20 may be forced to engage with a corresponding annular shoulder 39 (FIG. 3) of the tube 30 by the spring 27, such that the cap 28 and the follower 29 and the spring 27 may be retained in place (FIG. 2).

In operation, as shown in FIG. 2, the head of the fastener 40 may first be forced inward of the chuck 11 and may be engaged through the balls 112 when the balls 112 and the chuck 11 are forced inward of the barrel 10 against the spring 12 until the fastener 40 is engaged with the driving stem 29, such that the fastener 40 may be rotatably retained in place by the chuck 11. The balls 23 may be forced inward of the follower 20 by the annular bulge 38 (FIG. 2) to engage with the driving stem 29 for allowing the driving stem 29 to be rotated by the power tool via the follower 20 when the stud 21 of the follower 20 is coupled to and driven by the power tool. The chuck 11 may be forced inward of the barrel 10 against the spring 12 for releasing the head of the fastener 40 when the fastener 40 is partially driven into the object 80 (FIG. 3). The follower 20 and the cap 28 may be forced toward the tube 30 against the spring 27 in order to fully drive the fastener 40 into the object 80. When the fastener 40 is fully driven into the object 80, as shown in FIG. 3, the balls 23 may be disengaged from the annular bulge 38 and may be received in the annular recess 32 such that the driving stem 29 may not be driven by the follower 20 and the power tool at this moment.

Accordingly, the driving stem 29 will not be over-driven by the power tool after the fastener 40 is fully driven into the object 80 and when the balls 32 are disengaged from the annular bulge 38. The chuck device thus includes a safety mechanism for preventing the driving stem 29 and the fastener 40 from being over-driven by the power tool. The spring 27 may be used for disengaging the balls 23 from the annular recess 32.

Figure 4:
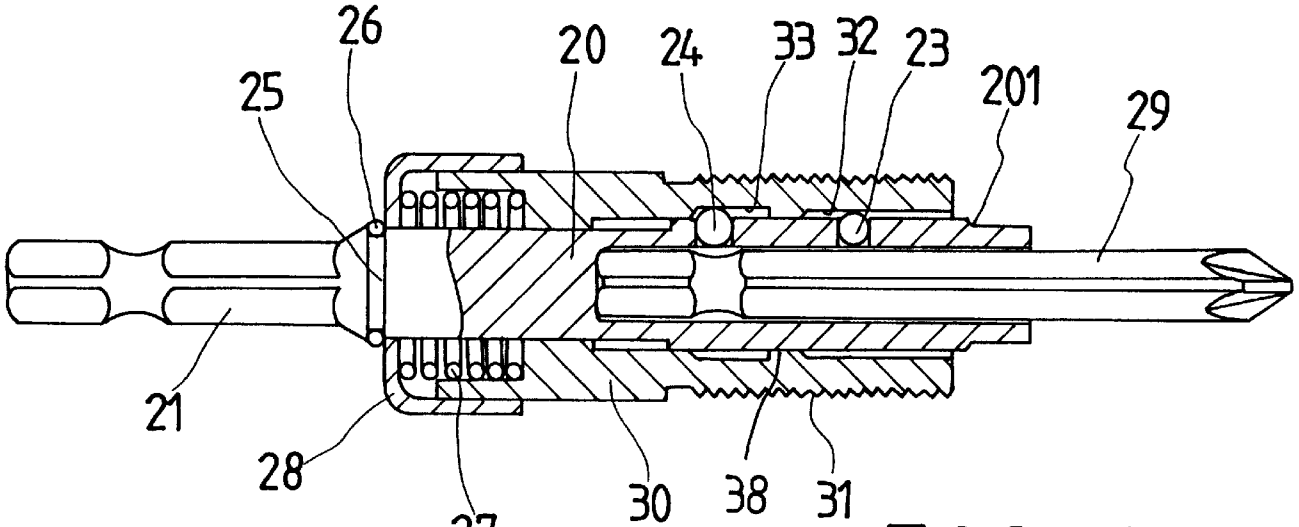
FIG. 4 is a cross sectional view illustrating the engagement of a driving member into the chuck device.

Referring next to FIG. 4, when the tube 30 is disengaged from the barrel 10 and when the cap 28 is forced toward the tube 30 against the spring 27, the ball 24 may be forced to engage with the annular groove 33 such that the driving stem 29 may be engaged into or disengaged from the follower 20. The driving stem 29 may be rotatably retained in the follower 20 when the cap 28 and the follower 20 are released and when the spring 27 bias the cap 28 away from the tube 30 again.

Figure 6:
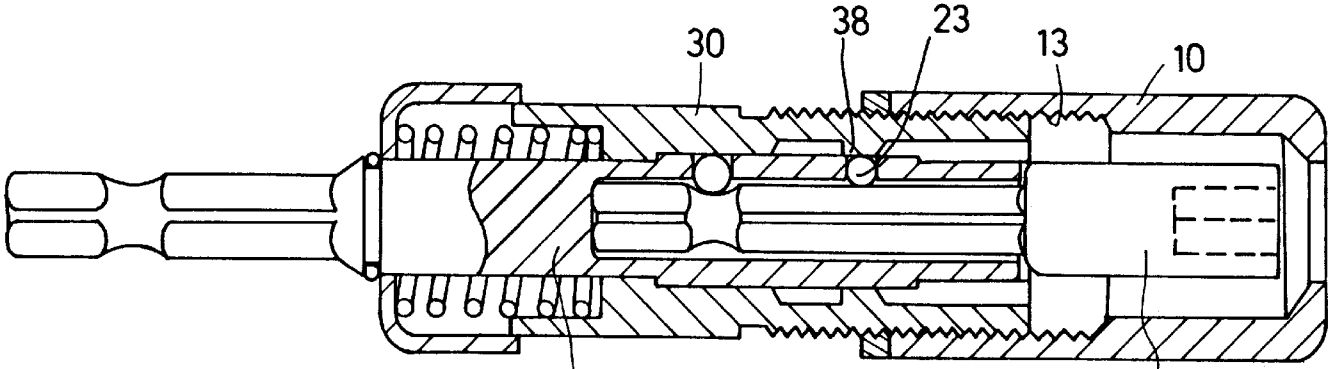
FIG. 6 is a cross sectional view of the chuck device as shown in FIG. 5.
Figure 5:
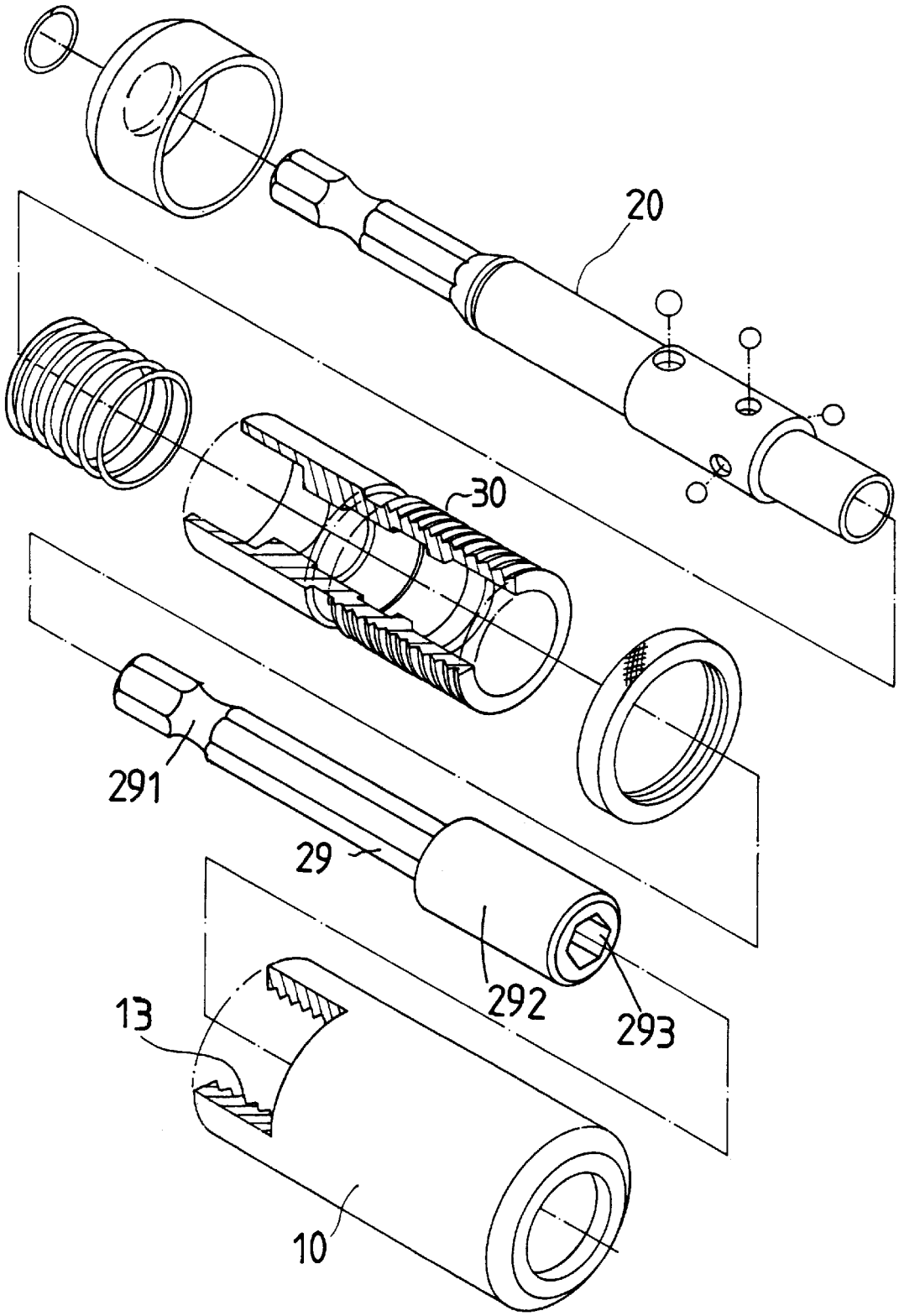
FIG. 5 is an exploded view illustrating another application of the chuck device.

Referring next to FIGS. 5 and 6, without the chuck 11, the driving stem 29 may include a socket 292 formed in the front portion and having an engaging hole 293 for receiving the fastener or the tool extension. The driving stem 29 may also be prevented from being over-driven by the power tool when the balls 23 are disengaged from the annular bulge 38 of the tube 30.

Accordingly, the chuck device in accordance with the present invention includes a safety device for preventing the driving member or the fastener from being over driven.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A chuck device for a power tool, said chuck device comprising:

a tube including an annular recess formed therein, a follower rotatably and slidably received in said tube, said follower including a first end having a hole formed therein and including a second end for coupling to and for being driven by the power tool, said follower including a middle portion having at least one orifice formed therein and including at least one first ball slidably received in said at least one orifice and movable inward of said follower, a driving stem rotatably received in said follower and including a first end for engaging with and for driving a fastener, said at least one first ball being forced inward of said hole of said follower to engage with said driving stem for allowing said driving stem to be driven by said follower, and said at least one first ball being disengaged from said driving stem when said follower is moved relative to said tube until said at least one first ball is received in said annular recess of said tube for preventing said driving stem from being over-driven by the power tool, means for disengaging said at least one first ball from said annular recess of said tube, means for rotatably securing said driving stem in said hole of said follower, and a barrel secured to said tube and close to said first end of said follower, a chuck slidably received in said barrel for retaining the fastener, and means for biasing said chuck away from said first end of said follower to retain the fastener.

2. The chuck device according to claim 1, wherein said at least one first ball disengaging means includes a cap secured to said second end of said follower and means for biasing said cap and said second end of said follower away from said tube to disengage said at least one first ball from said annular recess of said tube.

3. The chuck device according to claim 1, wherein said driving stem rotatably securing means includes an annular groove formed in said tube, an annular groove formed in said driving stem, an aperture formed in said follower, a second ball slidably received in said aperture of said follower and engaged in said hole of said follower for engaging with said annular groove of said driving stem and for rotatably securing said driving stem in said hole of said follower, said second ball is disengaged from said annular groove of said driving stem when said second ball is received in said annular groove of said tube.

* * * * *